US008815481B2

(12) United States Patent
Wu et al.

(10) Patent No.: US 8,815,481 B2
(45) Date of Patent: Aug. 26, 2014

(54) IMAGING MEMBER WITH FLUOROSULFONAMIDE-CONTAINING OVERCOAT LAYER

(71) Applicant: Xerox Corporation, Norwalk, CT (US)

(72) Inventors: Jin Wu, Pittsford, NY (US); David Skinner, Rochester, NY (US); Than Sorn, Walworth, NY (US); Lin Ma, Pittsford, NY (US); Lanhui Zhang, Webster, NY (US); Marissa Anne Linne, Annandale, NJ (US); J. Robinson Cowdery-Corvan, Webster, NY (US); Kenny-tuan T. Dinh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 59 days.

(21) Appl. No.: 13/627,432

(22) Filed: Sep. 26, 2012

(65) Prior Publication Data

US 2014/0087298 A1 Mar. 27, 2014

(51) Int. Cl.
*G03G 5/06* (2006.01)

(52) U.S. Cl.
USPC ..... 430/66; 430/57.1; 430/58.8

(58) Field of Classification Search
USPC ..... 430/66, 57.1, 58.8
See application file for complete search history.

(56) References Cited

U.S. PATENT DOCUMENTS

| | | | | |
|---|---|---|---|---|
| 4,286,033 | A | 8/1981 | Neyhart et al. | |
| 4,291,110 | A | 9/1981 | Lee | |
| 4,338,387 | A | 7/1982 | Hewitt | |
| 4,457,994 | A | 7/1984 | Pai et al. | |
| 4,871,634 | A | 10/1989 | Limburg et al. | |
| 5,702,854 | A | 12/1997 | Schank et al. | |
| 5,853,906 | A | 12/1998 | Hsieh | |
| 5,976,744 | A | 11/1999 | Fuller et al. | |
| 7,384,717 | B2 | 6/2008 | Dinh et al. | |
| 2008/0096123 | A1 * | 4/2008 | Shimada et al. | 430/127 |
| 2011/0053066 | A1 * | 3/2011 | Wu et al. | 430/58.8 |

OTHER PUBLICATIONS

U.S. Appl. No. 13/246,227, filed Sep. 27, 2011.
U.S. Appl. No. 13/572,095, filed Aug. 10, 2012.

* cited by examiner

*Primary Examiner* — Hoa V Le
(74) *Attorney, Agent, or Firm* — Pillsbury Winthrop Shaw Pittman LLP

(57) ABSTRACT

An imaging member includes a supporting substrate, an optional hole blocking layer, an optional adhesive layer, an imaging layer, and an overcoat layer, wherein the overcoat layer comprises a fluorosulfonamide. The overcoat layer can further include a charge transport compound and a melamine resin.

17 Claims, 3 Drawing Sheets

IMAGING MEMBER WITH FLUOROSULFONAMIDE-CONTAINING OVERCOAT LAYER

BACKGROUND

This disclosure is generally directed to an imaging member comprising a supporting substrate, an optional hole blocking layer, an optional adhesive layer, an imaging layer such as separate or combined charge generating layer and charge transport layer, and an overcoat layer comprising a fluorosulfonamide and optionally a charge transport compound and a melamine resin.

In electrophotography, also known as Xerography, electrophotographic imaging or elecrostatographic imaging, the surface of an electrophotographic plate, drum, belt or the like (imaging member or photoreceptor) containing a photoconductive insulating layer on a conductive layer is first uniformaly electrosatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic making particle son the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Although excellent toner images may be obtained with multilayered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, must be maintained. This places additional constraints on the quality of imaging member manufacturing, and thus on the manufacturing yield.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer. Physical and mechanical damage during prolonged use, especially the formation of surface scratch defects, is among the chief reasons for the failure of belt photoreceptors. Therefore, it is desirable to improve the mechanical robustness of photoreceptors, and particularly, to increase their scratch resistance, thereby prolonging their service life. Additionally, it is desirable to increase resistance to light shock so that image ghosting, background shading, and the like is minimized in prints.

Long life imaging members enable a significant run-cost reduction. Providing a protective overcoat layer is a conventional means of extending the useful life of imaging members. Such conventional approaches to extend the life include applying an overcoat layer with wear resistance. While this approach works for scorotron charging systems, it suffers drawbacks in other systems, such as where there is a trade-off between image quality, imaging member lifetime, and wear rate.

Despite the various approaches that have been taken for forming imaging members, there remains a need for improved imaging member design, to provide improved imaging performance and longer lifetime, reduced torque, reduced human and environmental health risks, and the like. These and other needs are believed to be achievable with the imaging members disclosed herein.

SUMMARY

This disclosure generally provides an imaging member comprising: a supporting substrate, an optional hole blocking layer, an optional adhesive layer, an imaging layer, and an overcoat layer, wherein the overcoat layer comprises a fluorosulfonamide.

In another embodiment, the imaging layer comprises: a supporting substrate, a hole blocking layer, an adhesive layer, an imaging layer, and an overcoat layer, wherein the overcoat layer comprises a fluorosulfonamide, a charge transport compound, and a melamine resin.

This disclosure also provides a method of making an imaging member, comprising: providing an imaging member comprising a supporting substrate, an optional hole blocking layer, an optional adhesive layer, and an imaging layer, and forming over the imaging layer an overcoat layer comprising a fluorosulfonamide, a charge transport compound, and a melamine resin. The forming can comprise the steps of applying to said imaging layer a solution comprising the fluorosulfonamide, the charge transport compound, and the melamine resin, and curing the solution to form the overcoat layer.

BRIEF DESCRIPTION OF DRAWINGS

Other aspects of the present disclosure will become apparent as the following description proceeds and upon reference to the following figures, which represent illustrative embodiments.

EMBODIMENTS

In this specification and the claims that follow, singular forms such as "a," "an," and "the" include plural forms unless the content clearly dictates otherwise.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4".

In embodiments of the present disclosure, there is illustrated an imaging member comprising a supporting substrate, an optional anticurl layer, an optinal hole blocking layer, an optional adhesive layer, an imaging layer such as a separate or combined charge generating layer and charge transport layer, and an overcoat layer. The overcoat layer comprises a fluorosulfonamide, and optionally also comprises a charge transport compound and a melamine resin.

Figure 1:
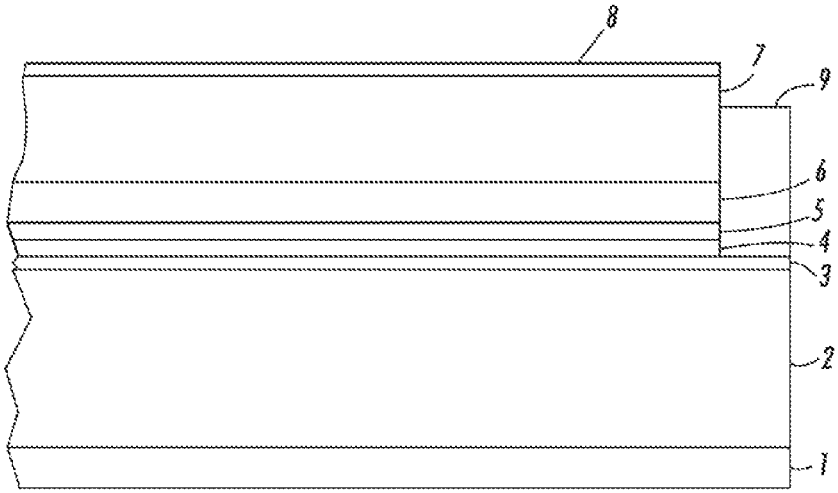
FIG. 1 represents a simplified side view of an exemplary imaging member of the present disclosure.
Figure 2:
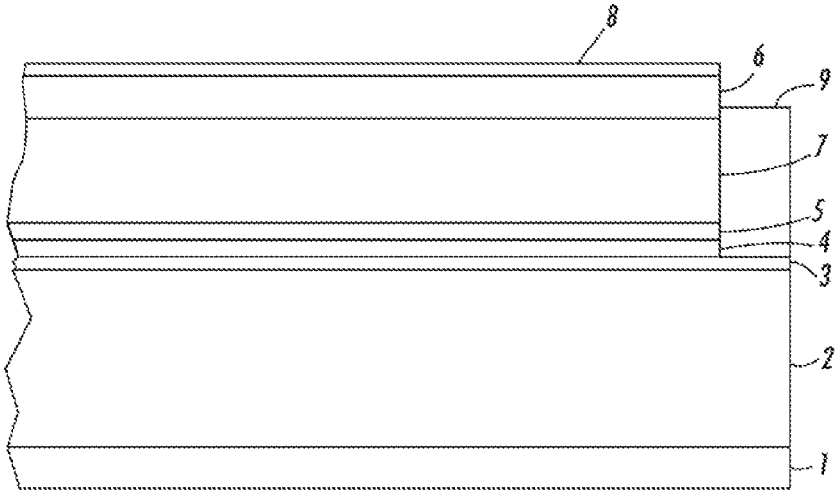
FIG. 2 represents a simplified side view of a second exemplary imaging member of the present disclosure.
Figure 3:
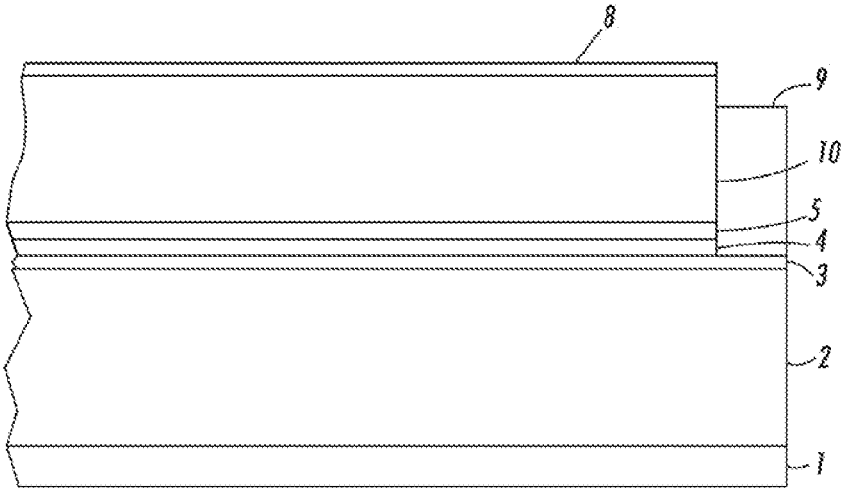
FIG. 3 represents a simplified side view of a third exemplary imaging member of the present disclosure.

Representative structures of an imaging member are shown in FIGS. 1-3. These imaging members are provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. In FIG. 3, imaging layer 10 (containing both charge generating material and charge transport material) takes the place of separate charge generating layer 6 and charge transport layer 7.

As seen in the figures, in fabricating an imaging member, a charge generating material (CGM) and a charge transport material (CTM) may be deposited onto the substrate surface either in a laminate type configuration where the CGM and CTM are in different layers (e.g., FIGS. 1 and 2) or in a single layer configuration where the CGM and CTM are in the same layer (e.g., FIG. 3). In embodiments, the imaging members may be prepared by applying over the electrically conductive layer the charge generation layer 6 and, optionally, a charge transport layer 7. In embodiments, the charge generation layer and, when present, the charge transport layer, may be applied in either order.

Anti Curl Layer

For some applications, and optional anti-curl layer 1, which generally comprises film-forming organic or inorganic polymers that are electrically insulating or slightly semi-conductive, may be provided. The anti-curl layer provides flatness and/or abrasion resistance.

Anti-curl layer 1 may be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Additives include organic and inorganic particles that may further improve the wear resistance and/or provide charge relaxation property. Organic particles include Teflon powder, carbon black, and graphite particles. Inorganic particles include insulating and semiconducting metal oxide particles such as silica, zinc oxide, tin oxide and the like. Another semiconducting additive is the oxidized oligomer salts as described in U.S. Pat. No. 5,853,906. The oligomer salts are oxidized N,N,N',N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers, such as from about 10 micrometers to about 20 micrometers, or about 14 micrometers.

The anti-curl coating may be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer may be accomplished simultaneously by web coating onto a multilayer imaging member comprising a charge transport layer, charge generation layer, adhesive layer, blocking layer, ground plane and substrate. The wet film coating is then dried to produce the anti-curl layer 1.

Supporting Substrate

As indicated above, the imaging members are prepared by first providing a substrate 2, i.e., a support. The substrate may be opaque or substantially transparent and may comprise any additional suitable material(s) having given required mechanical properties, such as those described in U.S. Pat. Nos. 4,457,994; 4,871,634; 5,702,854; 5,976,744; and 7,384,717, the disclosures of which are incorporated herein by reference in their entireties.

The substrate may comprise a layer of electrically non-conductive material or a layer of electrically conductive material, such as an inorganic or organic composition. If a non-conductive material is employed, it may be necessary to provide an electrically conductive ground plane over such non-conductive material. If a conductive material is used as the substrate, a separate ground plane layer may not be necessary.

The substrate may be flexible or rigid and may have any of a number of different configurations, such as, for example, a sheet, a scroll, an endless flexible belt, a web, a cylinder, and the like. The imaging member may be coated on a rigid, opaque, conducting substrate, such as an aluminum drum.

Various resins may be used as electrically non-conducting materials, including, for example, polyesters, polycarbonates, polyamides, polyurethanes, and the like. Such a substrate may comprise a commercially available biaxially oriented polyester known as MYLAR™, available from E.I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E.I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E.I. duPont de Nemours & Co. The photoreceptor may also be coated on an insulating plastic drum, provided a conducting ground plane has previously been coated on its surface, as described above. Such substrates may either be seamed or seamless.

When a conductive substrate is employed, any suitable conductive material may be used. For example, the conductive material can include, but is not limited to, metal flakes, powders, or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum may be used, as well as the conducting metal drum made from a material such as aluminum.

The thickness of the substrate depends on numerous factors, including the required mechanical performance and economic consideration. The thickness of the substrate is typically within a range of from about 65 micrometers to about 150 micrometers, such as from about 75 micrometers to about 125 micrometers for optimum flexibility and minimum induced surface bending stress when cycled around small diameter rollers, e.g., 19 mm diameter rollers. The substrate for a flexible belt may be of substantial thickens, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1-6 mm.

The surface of the substrate to which a layer is to be applied may be cleaned to promote greater adhesion of such a layer. Cleaning may be effected, for example, by exposing the surface of the substrate layer to plasma discharge, ion bombardment, and the like. Other methods, such as solvent cleaning, may also be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

Electrically Conductive Ground Plane

As stated above, in embodiments, the imaging members prepared comprise a substrate that is either electrically conductive or electrically non-conductive. When a non-conductive substrate is employed, an electrically conductive ground plane 3 can be employed, and the ground lane acts as the conductive layer. When a conductive substrate is employed, the substrate may act as the conductive layer, although a conductive ground plane may also be provided.

If an electrically conductive ground plane is used, it is positioned over the substrate. Suitable materials for the electrically conductive ground plane include, for example, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium may be used.

The ground plane may be applied by known coating techniques, such as solution coating, vapor deposition, and sputtering. A method of applying an electrically conductive ground plane is by vacuum deposition. Other suitable methods may also be used.

In embodiments, the thickness of the ground plane may vary over a substantially wide range, depending on the optical transparency and flexibility desired for the electrophotoconductive member. For example, for a flexible photoresponsive imaging device, the thickness of the conductive layer may be between about 20 angstroms and about 750 angstroms; such as from about 50 angstroms to about 200 angstroms for an optimum combination of electrical conductivity, flexibility, and light transmission. However, the ground plane can, if desired, be opaque.

Charge Blocking Layer

After deposition of any electrically conductive ground plane layer, a charge blocking layer 4 may be applied thereto. Electron blocking layers for positively charged imaging members permit holes from the imaging surface of the imaging member to migrate toward the conductive layer. For negatively charged imaging members, any suitable hole blocking layer capable of forming a barrier to prevent hole injection from the conductive layer to the opposite photoconductive layer may be utilized.

If a blocking layer is employed, it may be positioned over the electrically conductive layer. The term "over," as used herein in connection with many different types of layers, should be understood as not being limited to instances wherein the layers are contiguous. Rather, the term "over" refers, for example, to the relative placement of the layers and encompasses the inclusion of unspecified intermediate layers.

The blocking layer 4 may include polymers such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl)gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino)titanate, isopropyl trianthranil titanate, isopropyl tri(N,N-dimethyl-ethyl amino)titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387; 4,286,033; and 4,291,110, the disclosures of which are incorporated herein by reference in their entireties.

The blocking layer may be continuous and may have a thickness ranging, for example, from about 0.01 to about 10 micrometers, such as from about 0.05 to about 5 micrometers.

The blocking layer 4 may be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as by vacuum, heating, and the like. Generally, a weight ratio of blocking layer material and solvent of between about 0.5:100 to about 30:100, such as about 5:100 to about 20:100, is satisfactory for spray and dip coating.

The present disclosure further provides a method for forming the imaging members, in which the charge blocking layer is formed by using a coating solution composed of the grain shaped particles, the needle shaped particles, the binder resin and an organic solvent.

The organic solvent may be a mixture of an azeotropic mixture of $C_{1-3}$ lower alcohol and another organic solvent selected from the group consisting of dichloromethane, chloroform, 1,2-dichloroethane, 1,2-dichloropropane, toluene and tetrahydrofuran. The azeotropic mixture mentioned above is a mixture solution in which a composition of the liquid phase and a composition of the vapor phase are coincided with each other at a certain pressure to give a mixture having a constant boiling point. For example, a mixture consisting of 35 parts by weight of methanol and 65 parts by weight of 1,2-dichloroethane is an azeotropic solution. The presence of an azeotropic composition leads to uniform evaporation, thereby forming a uniform charge blocking layer without coating defects and improving storage stability of the charge blocking coating solution.

The binder resin contained in the blocking layer may be formed of the same materials as that of the blocking layer formed as a single resin layer. Among them, polyamide resin may be used because it satisfies various conditions required of the binder resin such as (i) polyamide resin is neither dissolved nor swollen in a solution used for forming the imaging layer on the blocking layer, and (ii) polyamide resin has an excellent adhesiveness with a conductive support as well as flexibility. In the polyamide resin, alcohol soluble nylon resin may be used, for example, copolymer nylon polymerized with 6-nylon, 6,6-nylon, 610-nylon, 11-nylon, 12-nylon and the like; and nylon which is chemically denatured such as N-alkoxy methyl denatured nylon and N-alkoxy ethyl denatured nylon. Another type of binder resin that may be used in a phenolic resin or polyvinyl butyral resin.

The charge blocking layer is formed by dispersing the binder resin, the grain shaped particles, and the needle shaped particles in the solvent to form a coating solution for the blocking layer; coating the conductive support with the coating solution and drying it. The solvent is selected for improving dispersion in the solvent and for preventing the coating solution from gelation with the elapse of time. Further, the azeotropic solvent may be used for preventing the composition of the coating solution form being changed as time passes, whereby storage stability of the coating solution may be improved and the coating solution may be reproduced.

The phrase "n-type" refers, for example, to materials which predominantly transport electrons. Typical n-type materials include dibromoanthanthrone, benzimidazole perylene, zinc oxide, titanium oxide, azo compounds such as chlorodiane Blue and bisazo pigments, substituted 2,4-dibromotriazines, polynuclear aromatic quinones, zinc sulfide, and the like. The phrase "p-type" refers, for example, to materials which transport holes. Typical p-type organic pigments include, for example, metal-free phthalocyanine, titanyl phthalocyanine, gallium phthalocyanine, hydroxy gallium phthalocyanine, chlorogallium phthalocyanine, copper phthalocyanine, and the like.

Adhesive Layer

An intermediate layer 5 between the blocking layer and the charge generating layer may, if desired, be provided to promote adhesion. However, in embodiments, a dip coated aluminum drum may be utilized without an adhesive layer.

Additionally, adhesive layers may be provided, if necessary, between any of the layers in the imaging members to ensure adhesion of any adjacent layers. Alternatively, or in addition, adhesive material may be incorporated into one or both of the respective layers to be adhered. Such optional adhesive layers may have thicknesses of about 0.001 micrometer to about 0.2 micrometer. Such an adhesive layer may be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E.I. duPont de Nemours & Co.), Vitel PE-100 (available from Goodyear Tire and Rubber Co.), polyvinyl butyral, polyvinyl pyrrolidone, polyurethane, polymethyl methacrylate, and the like. The adhesive layer may be composed of a polyester with a $M_w$ of from about 50,000 to about 100,000, such as about 70,000, and a $M_n$ of about 35,000.

Charge Generation Layer

Usually, the charge generating layer is applied by vacuum deposition or by spray drying onto the supporting substrate or underlying layer, and a charge transport layer or plurality of charge transport layers are formed on the charge generating layer. The charge transport layer may be situated on the charge generating layer, the charge generating layer may be situated on the charge transport layer, or when more than one charge transport layer is present, they can be contained on the charge generating layer. Also, the charge generating layer may be applied to layers that are situated between the supporting substrate and the charge transport layer.

Generally, the charge generating layer can contain known charge generating pigments, such as metal phthalocyanines, metal free phthalocyanines, alkylhydroxyl galliium phthalocyanines, hydroxygallium phthalocyanines, halogallium phthalocyanines, such as chlorogallium phthalocyanines, perylenes, such as bis(benzimidazo)perylene, titanyl phthalocyanines, especially Type V titanyl phthalocyanine, and the like, and mixtures thereof.

Examples of charge generating pigments included in the charge generating layer are vanadyl phthalocyanines, Type V hydroxygallium phthalocyanines, high sensitivity titanyl phthalocyanines, Type IV and V titanyl phthalocyanines, quinacridones, polycyclic pigments, such as dibromo anthanthrone pigments, perinone diamines, polynuclear aromatic quinones, azo pigments including bis-, tris- and tetrakis-azos, and the like and other known charge generating pigments; inorganic components such as selenium, selenium alloys, and trigonal selenium; and pigments of crystalline selenium and its alloys.

The charge generating pigment can be dispersed in a resin binder similar to the resin binders selected for the charge transport layer, or alternatively no resin binder need be present. For example, the charge generating pigments can be present in an optional resinous binder composition in various amounts inclusive of up to 99.5 percent by weight based on the total weight of the charge generating pigment is dispersed in about 95 to about 5 percent by volume of a resinous binder, or from about 20 to about 30 percent by volume of the charge generating pigment is dispersed in about 70 to about 80 percent by volume of the resinous binder composition. In one embodiment, about 90 percent by volume of the charge generating pigment is dispersed in about 10 percent by volume of the resinous binder composition.

Examples of polymeric binder materials that can be selected as the matrix for the charge generating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polymides, polymethylpentenes, poly(phenylene sulfides), poly(vinyl acetate), polysiloxanes, polyacrylates, polyvinyl acetals, polyamides, polyamides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the charge generating layer mixture that does not substantially disturb or adversely affect the previously coated layers of the imaging member. Examples of coating solvents used for the charge generating layer coating mixture include ketones, alcohols, aromatic hydrocarbons, halogenated aliphatic hydrocarbons, ethers, amines, amides, esters, and the like, and mixtures thereof. Specific solvent examples selected for the charge generating mixture are cyclohexanone, acetone, methyl ethyl ketone, methanol, ethanol, butanol, amyl alcohol, toluene, xylene, chlorobenzene, carbon tetrachloride, chloroform, methylene chloride, trichlorethylene, tetrahydrofuran, dioxane, diethyl ether, dimethyl formamide, dimethyl acetamide, butyl acetate, ethyl acetate, methoxyethyl acetate, and the like.

The charge generating layer can be of a thickness of from about 0.01 to about 10 microns, from about 0.05 to about 10 microns, from about 0.2 to about 2 microns, or from about 0.25 to about 1 micron.

Charge Transport Layer

The charge transport layer or layers generally comprise a mixture of a charge transporting compound or molecules dissolved or molecularly dispersed in a film forming electrically inert polymer such as a polycarbonate. In embodiments, "dissolved" refers, for example, to forming a solution in which the charge transport molecules are dissolved in a polymer to form a homogeneous phase; and "molecularly dispersed" refers, for example, to charge transporting molecules or compounds dispersed on a molecular scale in a polymer.

In embodiments, "charge transport" refers, for example, to charge transporting molecules that allows the free charge generated in the charge generating layer to be transported across the charge transport layer of layers. The charge transport layer is usually substantially nonabsorbing to visible light or radiation in the region of intended use, but is electrically "active" in that it allows the injection of holes from the charge generating layer, and allows these holes to be transported to selectively discharge a surface charge present on the surface of the imaging member.

A number of charge transport compounds can e included in the charge transport layer or in at least one charge transport layer where multiple (such as from 1 to about 4 layers, from 1 to about 3 layers, or 2 layers) are present. Examples of charge transport components or compounds present in an amount of from about 20 to about 80 weight percent, from about 30 to about 70 weight percent, or from about 40 to about 60 weight percent based on the total weight of the at least one charge transport layer are aryl amines selected from the group consisting of those represented by the following formulas/structures

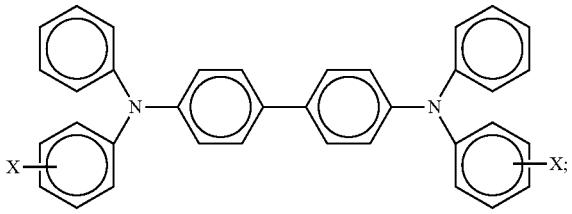

and

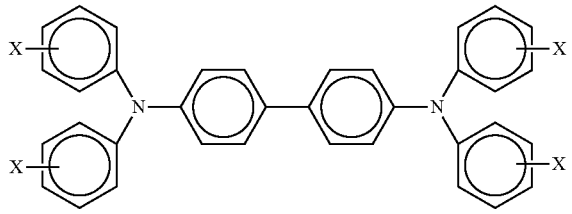

wherein X is a suitable hydrocarbon like alkyl, alkoxy, aryl, isomers thereof, and derivatives thereof like alkylaryl, alkoxyaryl, arylalkyl; a halogen, or mixtures of a suitable hydrocarbon and a halogen; and charge transport layer compounds as represented by the following formulas/structures

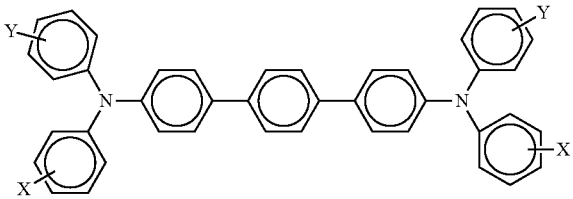

where X and Y are independently alkyl, alkoxy, aryl, a halogen, or mixture thereof.

The alkyl and alkoxy groups for the charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36, from 6 to about 24, from 6 to about 18, or from 6 to about 12 carbon atoms, such as phenyl, naphthyl, anthryl, and the like. Halogen substituents for the charge transport layer compounds include chloride, bromide, iodide, and fluoride. Substituted alkyls, substituted alkoxys, and substituted aryls can also be selected for the charge transport layer compounds.

Examples of specific aryl amines present in at least one photoconductor charge transport layer, in an amount of from about 20 to about 80 weight percent, from about 30 to about 70 weight percent, or from about 40 to about 60 weight percent, include N,N,N,'N'-tetra-p-tolyl-1,1'-biphenyl-4,4'-diamine, N,N'-diphenyl-N,N'-bis(alkylphenyl)-1,1'-biphenyl-4,4'-diamine wherein alkyl is selected from the group consisting of methyl, ethyl, propyl, butyl, hexyl, heptyl, octyl, nonyl, decyl, undecyl, dodecyl, pentadecyl, and the like; N,N'-diphenyl-N,N'-bis(halophenyl)-1,1'-biphenyl-4,4'-diamine wherein the halo substituent is chloro; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like.

A number of the charge transport compounds, such as N,N,N',N'-tetra-p-tolyl-1,1'-biphenyl-4,4'-diamine, tend to crystallize in the charge transport layer due, it is believed, to their symmetric structure. The crystallization extent is dependent on the charge transport layer thickness; the thicker the charge transport layer, such as a thickness of about 25 to about 50 microns, the more severe is the crystallization of the N,N,N',N'-tetra-p-tolyl-1,1'-biphenyl-4,4'-diamine.

Examples of binders that can be included in at least one charge transport layer in addition to the charge transport compound include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidene diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders that can be selected for the charge transport layer or charge transport layers can be comprised of polycarbonates resins with a weight average molecular weight $M_w$ of from about 20,000 to about 100,000, or of from about 50,000 to about 100,000.

The ratio of the binder to the charge transport compound present in the charge transport layer or in at least one charge transport layer can vary depending, for example, on the thickness of the imaging member layers, and the properties desired. Typically, the ratio of the binder to the charge transport compound, as primarily determined by the initial feed amounts of each, can range from about 50:50 to about 80:20, such as from about 55:45 to about 75:25, or from about 60:40 to about 70:30, or values in between these amounts.

A number of processes may be used to mix, and thereafter apply the charge transport layer or layers coating mixture to the charge generating or underlying layer. Typical application techniques include spraying, dip coating, roll coating, wire wound rod coating, and the like. Drying of the charge transport deposited layer coating or layer coatings may be affected by any suitable conventional technique such as oven drying, infrared radiation drying, air drying, and the like.

The thickness of the charge transport layer or charge transport layers, in embodiments, is from about 5 or about 10 to about 70 microns, from about 20 to about 65 microns, from about 15 to about 50 microns, or from about 10 to about 40 microns, but thicknesses outside this range may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the charge generating layer can be from about 2:1 to 200:1, and in some instances about 400:1.

Examples of components or materials optionally incorporated into at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057, and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd. Of Japan), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent based upon about 100 weight percent of all the components in the charge transport layer.

Overcoat Layer

The overcoat layer in contact with the top charge transport layer (or top charge generating layer of top combined charge transport and charge generating layer) comprises a fluorosulfonamide, and optionally a charge transport component or a charge transport compound, and a melamine resin.

In various embodiments, the melamine resin selected for the overcoat layer can be represented by the following structure:

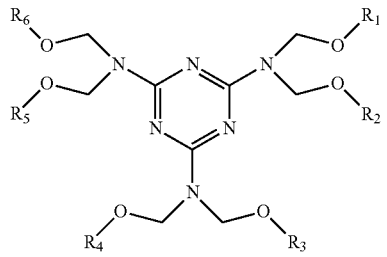

wherein $R_1$, $R_2$, $R_3$, $R_4$, $R_5$ and $R_6$ each independently represent a hydrogen atom or an alkyl group with, for example, from 1 to about 12 carbon atoms, from 1 to about 8 carbon atoms, or from 1 to about 4 carbon atoms. Examples of specific alkyl groups include methyl, ethyl, propyl, butyl, pentyl, hexyl, heptyl, octyl, nonyl, decyl, undecyl, dodecyl, pentadecyl, and the like.

Examples of melamine resins selected for the overcoat layer also include highly methylated and/or butylated melamine formaldehyde resins, such as those commercially available from Cytec Industries, as CYMEL® 303, 104, MM-100, and the like; NIKANAC® M-390; and the like. These melamine formaldehyde resins, which are water-soluble, dispersible or nondispersible, exhibit a high percent of alkylation, such as from about 75 to about 95 percent, from about 80 to about 95 percent, from about 75 to about 90 percent, or from about 85 to about 90 percent.

The methoxymethylated melamine resin CYMEL® 303, available from Cytec Industries as $(CH_3OCH_2)_6N_3C_3N_3$, and selected from the overcoat layer of embodiments is represented by the following formula/structure

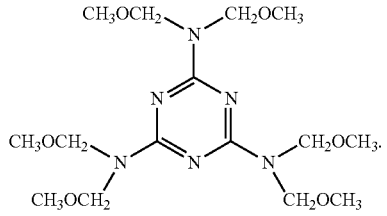

Other specific examples of melamine resins suitable for use in the overcoat layer include highly alkylated/alkoxylated resins (for example, having percent alkylation/alkoxylation of from about 75 to about 95 percent, from 80 to about 95 percent, from about 75 to about 90 percent, or from about 85 to about 90); partially or mixed alkylated/alkoxylated resins (for example, having from about 40 to about 65 percent alkylation/alkoxylation); methylated, n-butylated or isobutylated resins; highly methylated melamine resins such as CYMEL® 350, 9370; methylated imino melamine resins (partially methylolated and highly alkylated) such as CYMEL® 323, 327; partially methylated melamine resins (highly methylolated and partially methylated) such as CYMEL® 373, 370; high solids mixed ether melamine resins such as CYMEL® 1130, 324; n-butylated melamine resins such as CYMEL® 1151, 615; n-butylated high imino melamine resins such as CYMEL® 1158; and iso-butylated melamine resins such as CYMEL® 255-10. CYMEL® melamine resins are commercially available from CYTEC Industries, Inc. More specifically, the melamine resin may be selected from the group consisting of methylated melamine resins, methoxymethylated melamine resins, ethoxymethylated melamine resins, propoxymethylated melamine resins, butoxymethylated melamine resins, hexamethylol melamine resins, alkoxyalkylated melamine resins such as methoxymethylated melamine resin, ethoxymethylated melamine resin, propoxymethyalted melamine resin, butoxymethylated melamine resin, and mixtures thereof.

In embodiments, the charge transport component or compound selected for the photoconductor overcoat layer is a crosslinkable alcohol soluble compound represented by

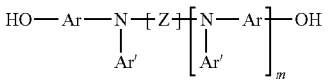

wherein m represents the number of segments and is, for example, 0 or 1; Z is selected from the group consisting of at least one of:

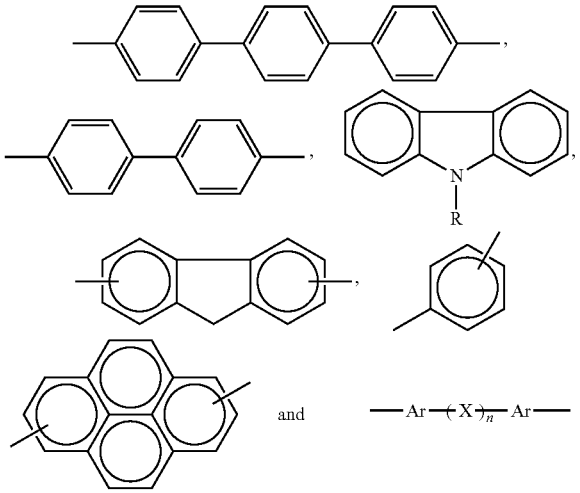

wherein n represents the number of X substituents, such as 0 or 1; Ar is selected from the group consisting of at least one of

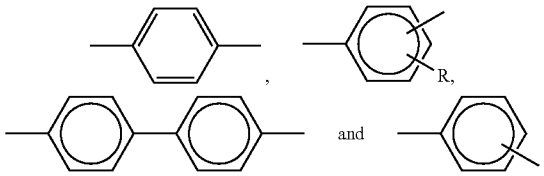

where R is selected from the group consisting of at least one of alkyl like methyl, ethyl, propyl, butyl, pentyl, and the like; Ar' is selected from the group consisting of at least one of

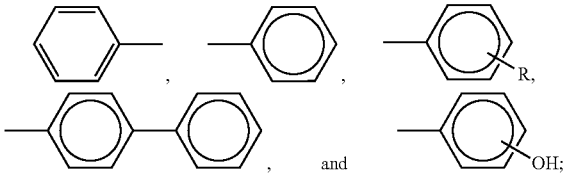

and X is selected from the group consisting of at least one of

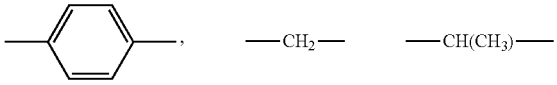

-continued

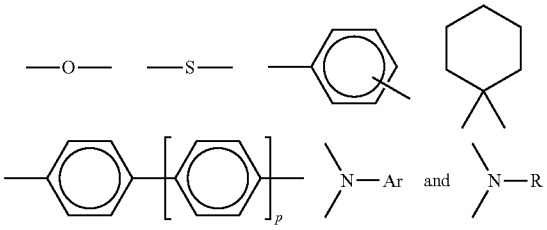

wherein p represents the number of segments and is, for example, zero, 1, or 2; R is alkyl, and Ar is selected from the group consisting of at least one of the substituents represented by the following formulas/structures

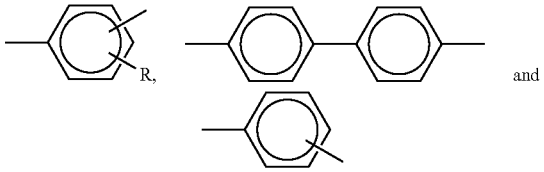

wherein R is alkyl.

Examples of charge transport compounds present in the overcoat layer are hydroxyl aryl amines represented by

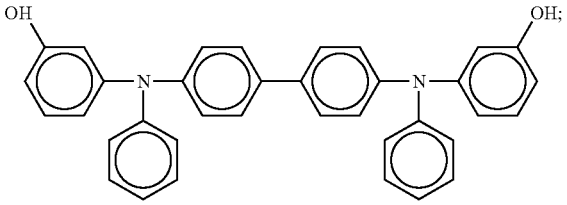

dihydroxyaryl terphenylamines represented by

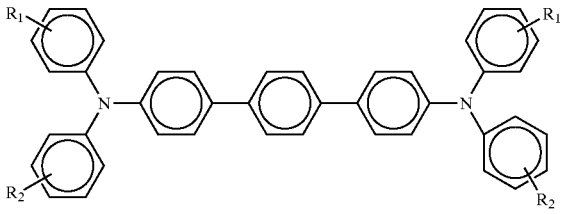

wherein each $R_1$ and $R_2$ is independently selected from the group consisting of at least one of a hydrogen atom, a hydroxy group, a group represented by $—C_nH_{2n+1}$ where n is from 1 to about 12 or from 1 to about 6, aralkyl, and aryl groups with from about 6 to about 36 carbon atoms, from about 6 to about 24 carbon atoms, from 6 to about 18 carbon atoms, or from 6 to about 12 carbon atoms, and mixtures of hydroxyl aryl amines and dihyroxyaryl terphenylamines.

To increase the wear resistance of the overcoat layer, and thus of the overall imaging member, the overcoat layer further includes a fluorosulfonamide. Any commercially available or developed fluorosulfonamide can be used. In embodiments, the fluorosulfonamide is a hydroxyl fluorosulfonamide. Hydroxyl fluorosulfonamides are particularly useful because the hydroxyl group can effectively crosslink with the melamine resin and a hydroxyl-containing hole transport molecule to form a crosslinked polymeric network.

Suitable fluorosulfonamides that can be used include, but are not limited to, those of the following structure:

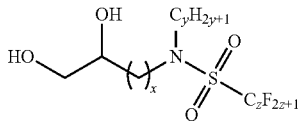

where x is an integer of from 1 to about 10, 1 to about 6, or 1 to about 4, such as 1, 2, 3, or 4; and y and z independently is each an integer of from 1 to about 24, 1 to about 20, or 1 to about 18, such as 1, 2, 3, 4, 5, 6, 7, 8, 9, 10, 11, 12, 13, 14, 15, 16, 17, or 18.

Specific examples of suitable fluorsulfonamides include, but are not limited to, N-n-propyl-N-(2,3-dihydroxypropyl) perfluorooctylsulfonamide, N-n-propyl-N-(2,3-dihydroxypropyl)perfluoroheptylsulfonamide, N-n-propyl-N-(2,3-dihydroxypropyl)perfluorohexylsulfonamide, N-n-propyl-N-(2,3-dihydroxypropyl)perfluoroamylsulfonamide, N-n-propyl-N-(2,3-dihydroxpyropyl)perfluoronoylsulfonamide, N-n-propyl-N-(2,3-dihydroxypropyl)perfluordecylsulfonamide, N-n-propyl-N-(2,3-dihyroxypropyl)perflurododecylsulfonamide, N-n-propyl-N-(2,3-dihydroxypropyl)perfluoroheptadecylsulfonamide, N-n-propyl-N-(2,3-dihydroxypropl)perfluoropentadecylsulfonamide, N-n-propyl-N-(2,3-dihydroxypropyl) perfluoroundecylsulfonamide, and the like and mixtures thereof.

The fluorosulfonamide, either singularly or as a combination of two or more different fluorosulfonamides, can be included in the overcoat layer in any suitable amount. For example, the one or more fluorosulfonamides can be included in the overcoat layer in an amount of from about 1 to about 55 percent by weight of the solids content of the overcoat layer, such as from about 5 to about 50 percent, or about 10 to about 45 percent.

There may also be included in the overcoat layer low surface energy components, such as hydroxyl terminated fluorinated additives, hydroxyl silicone modified polyacrylates, and mixtures thereof. Examples of the low surface energy components, present in various effective amounts, such as from about 0.1 to about 10 weight percent, from about 0.5 to about 5 weight percent, or from about 1 to about 3 weight percent, based on the total weight of the overcoat layer, are hydroxyl derivatives of perfluoropolyoxyalkanes such as FLUOROLINK® D (M.W. about 1,000 and fluorine content about 62 percent), FLUOROLINK® D10-H (M.W. about 700 and fluorine content about 61 percent), and FLUOROLINK® D10 (M.W. about 500 and fluorine content about 60 percent) (functional group —$CH_2OH$); FLUOROLINK® E (M.W. about 1,000 and fluorine content about 58 percent) and FLUOROLINK® E10 (M.W. about 500 and fluorine content about 56 percent) (functional group —$CH_2(OCH_2CH_2)_nOH$); FLUOROLINK® T (weight average molecular weight, M.W. about 550 and fluorine content about 58 percent) and FLUOROLINK® T10 (M.W. about 330 and fluorine content about 55 percent) (functional group —$CH_2OCH_2CH(OH)CH_2OH$); and hydroxyl derivatives of perfluoroalkanes ($R_fCH_2CH_2OH$, wherein $R_f$=$F(CF_2CF_2)_n$) such as ZONYL® BA (M.W. about 460 and fluorine content about 71 percent), ZONYL® BA-LD (M.W. about 420 and fluorine content about 70 percent), and ZONYL® BA-N (M.W. about 530 and fluorine content about 71 percent); carboxylic acid derivatives of fluoropolyethers such as FLUOROLINK® C (M.W. about 1,000 and fluorine content about 61 percent), carboxylic ester derivatives of fluoropolyethers such as FLUOROLINK® L (M.W. about 1,000 and fluorine content about 60 percent), FLUOROLINK® L10 (M.W. about 500 and fluorine content about 58 percent), carboxylic ester derivatives of perfluoroalkanes ($R_fCH_2CH_2O(C{=}O)R$, wherein $R_f$=$F(CF_2CF_2)_n$ and R is alkyl) such as ZONYL® TA-N (fluoroalkyl acrylate, R=$CH_2$=CH—, M.W. about 570 and fluorine content about 64 percent), ZONYL® TM (fluoroalkyl methacrylate, R=$CH_2$=$C(CH_3)$—, M.W. about 530 and fluorine content about 60 percent), ZONYL® FTS (fluoroalkyl stearate, R=$C_{17}H_{35}$—, M.W. about 700 and fluorine content about 47 percent), ZONYL® TBC (fluoroalkyl citrate, M.W. about 1,560 and fluorine content about 63 percent), sulfonic acid derivatives of perfluoroalkanes ($R_fCH_2CH_2$ $SO_3H$, wherein $R_f$=$F(CF_2CF_2)_n$) such as ZONYL® TBS (M.W. about 530 and fluorine content about 62 percent); ethoxysilane derivatives of fluoropolyethers such as FLUOROLINK® S10 (M.W. about 1,750 to 1,950); phosphate derivatives of fluoropolyethers such as FLUOROLINK® F10 (M.W. about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, Inc., ZONYL® is a trademark of E.I. DuPont, and BYK-SILCLEAN® is a trademark of BYK SILCLEAN.

The melamine resin, which can function as a crosslinking agent, can be present in the overcoat layer mixture in an amount of from about 1 to about 65 weight percent, from about 2 to about 50 weight percent, or from about 3 to about 35 weight percent based on the tool weight of the overcoat layer. The charge transport compound can be present in the overcoat layer mixture in an amount of from about 20 to about 80 weight percent, from about 30 to about 75 weight percent, or from about 40 to about 70 weight percent based on the total solid content weight of the overcoat layer. While not being desired to be limited by theory, it is believed that the crosslinking percentage of the overcoat layer components is from about 77 to about 99 percent, from about 80 to about 95 percent, or from about 70 to about 90 percent, as determined by known methods, such as determined with Fourier Transform Infrared Spectroscopy (FTIR).

The crosslinking reaction of the melamine resin, the fluorosulfonamide, and the charge transport material can be catalyzed with an acid catalyst, such as a strong acid catalyst. The acid can be unblocked or blocked. Examples of strong acid catalysts include p-toluene sulfonic acid (p-TSA), dinonylnaphthalenedisulfonic acid (DNNDSA), dinonylnaphthalenesulfonic acid (DNNSA), dodecylbenzenesulfonic acid (DDBSA), commercially available acid catalysts available from CYCAT® (Cytec Industries, INC.) such as CYCAT® 600, CYCAT® 4040, and NACURE® (Kings Industries, Inc.) such as NACURE® 3525, NACURE® 1557, NACURE® 5225, NACURE® 2530, NACURE® XP-357, and the like. In embodiments, the catalyst is added to the overcoat layer mixture components in an amount of from about 0.1 to about 5 weight percent, from about 0.3 to about 3 weight percent, or from about 0.4 to about 1 weight percent.

The overcoat layer, in embodiments of the present disclosure, can be prepared by coating a solution of a solvent like an alcohol, the fluorosulfonamide, the melamine resin, the acid catalyst, the charge transport compound, and any other additives onto the underlying layer of the imaging member; heating to a temperature of from about 120° C. to about 200° C. for a period of from about 30 minutes to about 120 minutes; and allowing the resulting mixture to cool to room temperature (about 25° C.). Any suitable solvent, such as a primary, secondary or tertiary alcohol solvent, can be employed for the deposition of the film forming overcoat layer. Typical alcohol solvents include, but are not limited to, tert-butanol, sec-butanol, n-butanol, 2-propanol, 1-methoxy-2-propanol, cyclopentanol, and the like, and mixtures thereof. There may also be selected as deposition solvents for the forming of the overcoat layer cyclopentanone, tetrahydrofuran, monochlorobenzene, methylene chloride, toluene, xylene and mixtures thereof.

The thickness of the overcoat layer as measured with a Permascope is from about 1 to about 20 microns, from about 1 to about 15 microns, from about 1 to about 10 microns, or from about 1 to about 5 microns. Typical application techniques for applying the overcoat layer over the underlying layer can include spraying, dip coating, roll coating, wire wound rod coating, extrusion coating, flow coating, and the like. Drying of the deposited overcoat layer can be effected by any suitable conventional technique such as oven drying, infrared radiation drying, air drying, and the like.

The applied material can be cured, such as thermal cured, to provide a solid layer with excellent electrical properties and very low wear rate of from about 2 to about 20 nanometers/kilocycle, or from about 3 to about 15 nanometers/kilocycle, or from about 4 to about 10 nanometers/kilocycle under biased charge roller (BCR).

Imaging and Printing Methods

Also included within the scope of the present disclosure are methods of imaging and printing with the imaging members illustrated herein. These methods generally involve the formation of an electrostatic latent image on the imaging member, followed by developing the image with a toner composition comprised, for example, of thermoplastic resin, colorant, such as pigment, charge additive, and surface additive, subsequently transferring the toner image to a suitable image receiving substrate, and permanently affixing the image thereto. In those environments wherein the imaging member is to be used in a printing mode, the imaging method involves the same operation with the exception that exposure can be accomplished with a laser device or image bar. More specifically, the imaging members disclosed herein can be selected for the Xerox Corporation iGEN® machines that generate with some versions over 100 copies per minute. Processes of imaging, especially xerographic imaging and printing, including digital and/or color printing are thus encompassed by the present disclosure. The imaging members are, in embodiments, sensitive in the wavelength region of, for example, from about 400 to about 900 nanometers, and from about 650 to about 850 nanometers, thus diode lasers can be selected as the light source. Moreover, the imaging members of this disclosure are useful in color xerographic applications, particularly high-speed color copying and printing processes inclusive of digital xerographic processes.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

5 wt % of the melamine formaldehyde resin NIKANAC® M-309 obtained from Japan, 35 wt % of a hydroxyl fluorosulfonamide N-n-propyl-N-(2,3-dihydroxypropyl)perfluorooctylsulfonamide having the following structure:

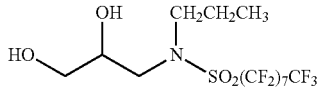

and 60 wt % of a hydroxyl hole transport material Ab-118 having the following structure:

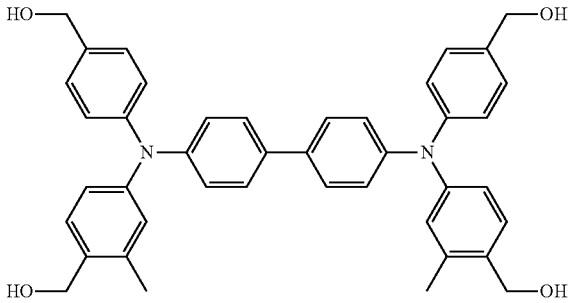

are dissolved in Dowanol with a solid content of about 35 wt %. 1 wt % of SILCLEAN® 3700 obtained from BYK Chemie and 1 wt % of a blocked acid, NACURE® XP-357 obtained from Kings Industries, Inc. are then added to make a final coating solution.

A photoconductor is prepared comprising 19 micron DUC AL, an undercoat layer of zinc oxide dispersed in a poly(vinyl butyral)/polyisocyanate binder, a 0.2 micron fine hydroxygallium phthalocyanine (Pc-7) dispersed in a poly(vinyl chloride-co-vinyl acetate-co-maleic acid) charge generation layer (CGL), and a 22 micron charge transport layer of PCZ-500/mTBD/SURFLON NIKANAC® S-651 in a ratio of 58/42/13 ppm. Next, a 6.2 micron overcoat layer is formed using the prepared coating solution. The overcoat layer is cured at 155° C. for 40 minutes.

Testing and Evaluation

Figure 4:
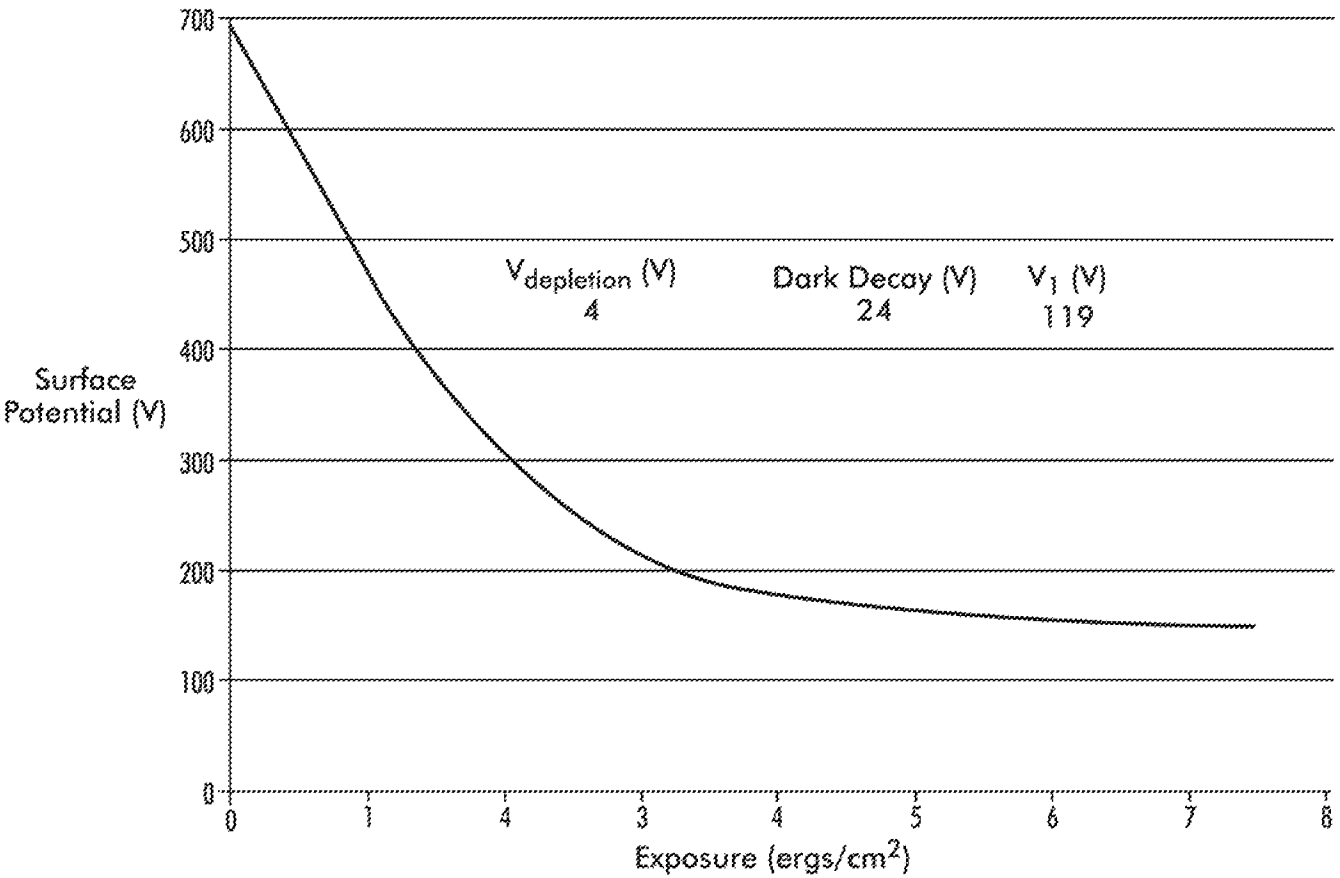
FIG. 4 is a graph of the photo-induced discharge curve of the imaging member of Example 1.

The photoinduced discharge curves (PIDC) of the resultant imaging member of Example 1 is obtained at t=0. The result is shown in FIG. 4. Good PIDC is obtained from this overcoated photoconductor with a residual potential of 119V, a $V_{depletion}$ of 4V and a dark decay of 24V.

Wear Rate is obtained using an accelerated photoreceptor wear fixture. The imaging member surface wear is evaluated using a Xerox F469 CRU drum/toner cartridge with BCR peak to peak voltage of 1.8 kV. The surface wear is determined by the change in thickness of the imaging member after 100,000 cycles in the F469 CRU with cleaning blade and single component toner. The thickness is measured using a Permascope ECT-100 at one inch intervals from the top edge of the coating along its length. All of the recorded thickness values are averaged to obtain an average thickness of the entire photoreceptor device. The change in thickness after 100,000 cycles is measured in nanometers and then divided by the number of kcycles to obtain the wear rate in nanometers per kcycle. This accelerated photoreceptor wear fixture achieves much higher wear rates than those observed in an actual machine used in a xerographic system, where wear rates are generally five to ten times lower depending on the xerographic system.

The wear was for the imaging member of Example 1 after 100,000 cycles is determined to be about 4.6 nm/kcycle. In contrast, the wear was for overcoated imaging members with no fluorosulfonamide after 100,000 cycles is determined to be about 10-15 nm/kcycle for each imaging member.

It will be appreciated that various of the above-disclosed and other features and functions, or alternatives thereof, may be desirably combined into many other different systems of applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a supporting substrate, an optional hole blocking layer, an optional adhesive layer, an imaging layer, and an overcoat layer, wherein the overcoat layer comprises a hydroxyl fluorosulfonamide, melamine resin and a hydroxyl-containing charge transport molecule.

2. The imaging member of claim 1, wherein the fluorosulfonamide is represented by the following structure:

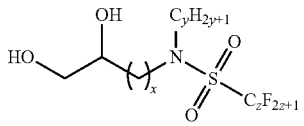

wherein x is an integer of from 1 to about 10, and y and z independently is each an integer of from 1 to about 24.

3. The imaging member of claim 2, wherein x is an integer of from 1 to about 4, and y and z independently is each an integer of from 1 to about 18.

4. The imaging member of claim 1, wherein the fluorosulfonamide is selected from the group consisting of N-n-propyl-N-(2,3-dihydroxypropyl)perfluorooctylsulfonamide, N-n-propyl-N-(2,3-dihydroxypropyl)perfluoroheptylsulfonamide, N-n-propyl-N-(2,3-dihydroxypropyl)perfluorohexylsulfonamide, N-n-propyl-N-(2,3-dihydroxypropyl)perfluoroamylsulfonamide, N-n-propyl-N-(2,3-dihydroxypropyl)perfluorononylsulfonamide, N-n-propyl-N-(2,3-dihydroxypropyl)perfluorodecylsulfonamide, N-n-propyl-N-(2,3-dihydroxypropyl) perfluorododecylsulfonamide, N-n-propyl-N-(2,3-dihydroxypropyl)perfluoroheptadecylsulfonamide, N-n-propyl-N-(2,3-dihydroxypropyl) perfluoropentadecylsulfonamide, N-n-propyl-N-(2,3-dihydroxypropyl)perfluoroundecylsulfonamide, and mixtures thereof.

5. The imaging member of claim 1, wherein the fluorosulfonamide is present in an amount of from about 1 to about 55 percent by weight of the solids content of the overcoat layer.

6. The imaging member of claim 1, wherein the fluorosulfonamide is present in an amount of from about 5 to about 45 percent by weight of the solids content of the overcoat layer.

7. The imaging member of claim 1, wherein the melamine resin is represented by the following structure:

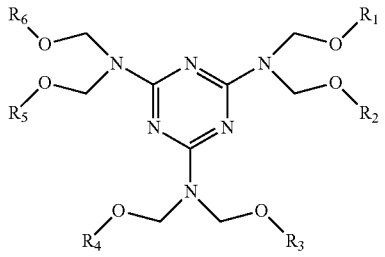

wherein $R_1$, $R_2$, $R_3$, $R_4$, $R_5$ and $R_6$ are independently selected from the group consisting of at least one of a hydrogen atom and an alkyl group.

8. The imaging member of claim 1, wherein the melamine resin is selected from the group consisting of methylated melamine resins, methoxymethylated melamine resins, ethoxymethylated melamine resins, propoxymethylated melamine resins, butoxymethylated melamine resins, hexamethylol melamine resins, methoxymethylated melamine resins, ethoxymethylated melamine resins, propoxymethylated melamine resins, butoxymethylated melamine resins, and mixtures thereof.

9. The imaging member of claim 1, wherein the charge transport compound in said overcoat layer is represented by

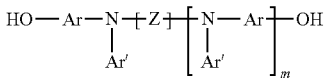

wherein m is 0 or 1;

Z is selected from the group consisting of at least one of:

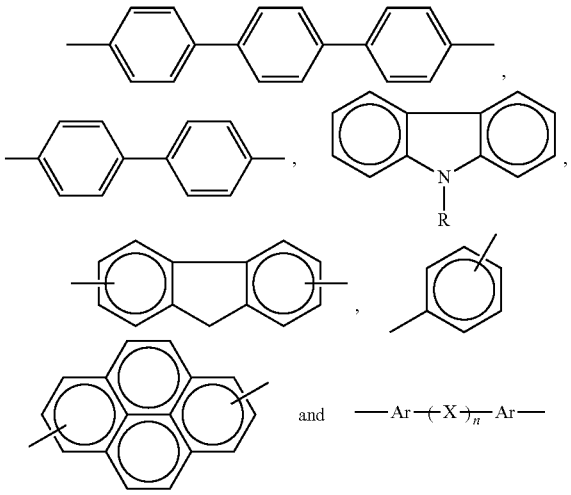

wherein n is 0 or 1;

Ar is selected from the group consisting of at least one of

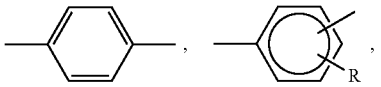

-continued

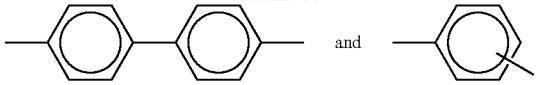

where R is selected from the group consisting of methyl, ethyl, propyl, butyl, and pentyl;

Ar' is selected from the group consisting of

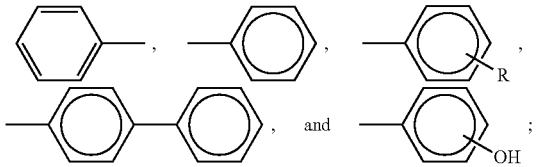

and X is selected from the group consisting of

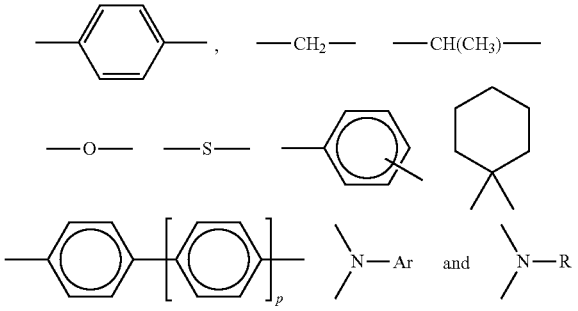

wherein p is 0, 1, or 2, R is alkyl, and Ar is selected from the group consisting of

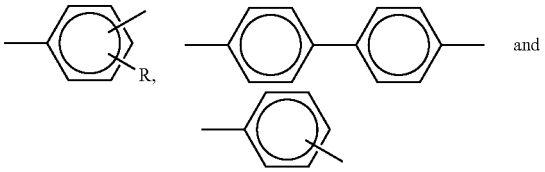

wherein R is alkyl.

10. The imaging member of claim 1, wherein the imaging layer comprises a charge generating layer and a separate charge transport layer comprising a charge transport compound in a resin binder.

11. The imaging member of claim 1, wherein the imaging layer comprises a layer comprising a charge generating material mixed with a charge transport compound in a resin binder.

12. The imaging member of claim 1, wherein the imaging layer comprises at least one charge transport compound selected from the group consisting of N,N,N',N'-tetra-p-tolyl-1,1'-biphenyl-4,4'-diamine, N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

13. The imaging member of claim 1, wherein the overcoat layer exhibits a wear rate of from about 2 to about 6 nanometers/kilocycle under a biased charge roller.

14. An imaging member comprising:

a supporting substrate, an optional hole blocking layer, an optional adhesive layer, an imaging layer, and an overcoat layer, wherein the overcoat layer comprises a hydroxyl fluorosulfonamide, a hydroxyl-containing charge transport compound, and a melamine resin, and wherein the overcoat layer exhibits a wear rate of from about 4 to about 5 nanometers/kilocycle under a biased charge roller.

15. The imaging member of claim 14, wherein the fluorosulfonamide is a hydroxyl fluorosulfonamide represented by the following structure:

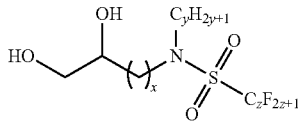

wherein x is an integer of from 1 to about 10, and y and z independently is each an integer of from 1 to about 24.

16. A method of making an imaging member, comprising:

providing an imaging member comprising a supporting substrate, an optional hole blocking layer, an optional adhesive layer, and an imaging layer, and forming over the imaging layer an overcoat layer comprising a hydroxyl fluorosulfonamide, a hydroxyl-containing charge transport compound, and a melamine resin.

17. The method of claim 16, wherein the forming comprises:

applying to said imaging layer a solution comprising the fluorosulfonamide, the charge transport compound, and the melamine resin, and curing the solution to form the overcoat layer.

* * * * *